US008638972B2

(12) United States Patent
Kaneko et al.

(10) Patent No.: US 8,638,972 B2
(45) Date of Patent: Jan. 28, 2014

(54) EARPHONE

(75) Inventors: Tomonari Kaneko, Yamato (JP); Atsuhito Horino, Yamato (JP); Yoshimi Aoyagi, Yamato (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 13/641,485

(22) PCT Filed: Apr. 18, 2011

(86) PCT No.: PCT/US2011/032891

§ 371 (c)(1),
(2), (4) Date: Mar. 4, 2013

(87) PCT Pub. No.: WO2011/130739

PCT Pub. Date: Oct. 20, 2011

(65) Prior Publication Data

US 2013/0170692 A1 Jul. 4, 2013

(30) Foreign Application Priority Data

Apr. 16, 2010 (JP) ..... 2010-094833

(51) Int. Cl.
*H04R 25/00* (2006.01)

(52) U.S. Cl.
USPC ..... 381/380; 381/370; 381/384

(58) Field of Classification Search
USPC ..... 381/309, 328, 370, 371, 374, 375, 376, 381/380, 381, 384, 385; 181/129, 130, 135; 379/430
See application file for complete search history.

(56) References Cited

U.S. PATENT DOCUMENTS 4,720,857 A * 1/1988 Burris et al. ..... 379/430
5,581,622 A * 12/1996 Sakurai ..... 381/370
8,265,322 B2 * 9/2012 Uchida et al. ..... 381/370

FOREIGN PATENT DOCUMENTS

JP 07-115695 5/1995
JP 2008-193449 8/2008
JP 2008-283398 11/2008

OTHER PUBLICATIONS

International Search Report for PCT/US2011/032891.

* cited by examiner

*Primary Examiner* — Huyen D Le
(74) *Attorney, Agent, or Firm* — Timothy M. Morella

(57) ABSTRACT

An earphone that possesses an outer ear canal insertion member for which at least a portion can be inserted into the outer ear canal, a housing onto which the outer ear canal insertion member is installed, a driver unit which is disposed within the housing and which generates sound, a first retention member through the interior of which passes a cable connected at one end to the driver unit and which is itself directly installed to the housing, and a second retention member through the interior of which passes the cable and which is itself installed to the first retention member; and when the second retention member is installed to the first retention member, the first retention member grasps the cable.

7 Claims, 6 Drawing Sheets

(a)

(b)

EARPHONE

REFERENCE TO RELATED APPLICATIONS

The Present Disclosure claims priority to prior-filed Japanese Patent Application No. 2010-094833, entitled "Earphone," filed on 16 Apr. 2010 with the Japanese Patent Office. The contents of the aforementioned Patent Application is fully incorporated in its entirety herein.

BACKGROUND OF THE PRESENT DISCLOSURE

The Present Disclosure relates to earphones that possess an outer ear canal insertion component for which at least a portion is to be inserted into the outer ear canal.

Formerly, as an earphone used by being mounted on the pinna, there have been known those of the type called earphone headphones, which do not provide a protrusion to be inserted into the outer ear canal, and so-called insertion type earphones, which are constituted of such as a soft rubber having elasticity and which insert an ear pad into the outer ear canal. See, for example, Japanese Patent Application 2008-193449. Such earphones possess a dynamic type driver unit and generate sound by vibrating a vibration plate provided by the driver unit.

FIG. 6 is a cross section drawing that shows the structure of the former technology earphone. In FIG. 6, 811 is the earphone housing, and within housing 811 there is installed driver unit 841 that provides a vibration plate. Additionally, at the leading end of housing 811 (right end in the drawing), there is integrally connected the base end of acoustic conduit 817 which extends toward the right. Within acoustic conduit 817 is formed a sound conducting hole with passage through the space within the housing. At the periphery of acoustic conduit 817 is attached with mating ear pad 850 constituted of such as a soft rubber. As such, when the earphone is mounted, the leading end of ear pad 850 is inserted into the outer ear canal. Sound generated by vibration of the vibration plate of driver unit 841 passes through the hole within acoustic conduit 817 and ear pad 850 and enters the outer ear canal, after which it arrives at the eardrum.

Comparatively, at the aft end of housing 811 (left end in the drawing), there is installed cover casing 814, and from the lower surface with bordering by cover casing 814 and housing 811 there extends duct-shaped cable support 815. Within cable support 815 there is housed electric cable 891, which is connected at one end to driver unit 841 and connected at the other end to the audio device not shown in the drawing, being such as a music player, television, radio, or video deck.

If electric cable 891 is pulled from the outer side, there is potential for the connection with driver unit 841 to become broken, and electric cable 891 may become separated from housing 811 and cable support 815. For that reason, knot 891*a* is formed at the end section of electric cable 891, and it is housed in a space within cover casing 814. Knot 891*a* is of a size sufficiently larger than the inner diameter of cable support 815 that it will catch on the upper edge of cable support 815 when electric cable 891 is pulled from the outer side, and therefore it functions as a stopper. This enables preventing the separation of electric cable 891.

SUMMARY OF THE PRESENT DISCLOSURE

With the earphone of the prior art described above, in order to house knot 891*a* within cover casing 814, not only must cover casing 814 be enlarged but also housing 811. This hinders reducing the size of the earphone.

Additionally, the space within cover casing 814 and housing 811 is made to accommodate knot 891*a*, regardless of whether or not it may be a component that applies a large adverse impact on the acoustic performance of the earphone as an acoustic space. This reduces the acoustic performance of the earphone.

Furthermore, formation of knot 891*a* is performed by a manual operation, because automation with machinery is difficult. This results in variation of the size for instances of knot 891*a*, and to absorb that variation, cover casing 814 and housing 811 must be made larger; this also causes variation in the volume of the space within cover casing 814 and housing 811, which is the acoustic space, with resulting variation for the acoustic performance of the earphone.

The Present Disclosure solves the above described problems with the former technology earphones, and it has as its purpose the offering of compact high audio quality earphone, of a simple structure, that is able to reliably prevent separation of the cable, by grasping the cable with a first retention member installed on the housing and a second retention member installed onto the first retention member, and can be easily manufactured, without forming a knot on the cable.

With the earphone of this invention, there is possessed an outer ear canal insertion member for which at least a portion can be inserted into the outer ear canal, a housing onto which the outer ear canal insertion member is installed, a driver unit which is disposed within the housing and which generates sound, a first retention member through the interior of which passes a cable connected at one end to the driver unit and which is itself directly installed to the housing, and a second retention member through the interior of which passes the cable and which is itself installed to the first retention member; and when the second retention member is installed to the first retention member, the first retention member grasps the cable.

Additionally, with the earphone of this invention, the housing provides a main housing that houses the driver unit, and a cover casing that plugs the aft surface of the main housing, and the first retention member is installed to an installation hole formed with straddling of the borderline between the main housing and the cover casing.

Furthermore, with the earphone of this invention, the first retention member provides a trunk section on the outer surface of which is formed a male thread, as well as a leg section connected to one end of the trunk section, and the second retention member provides a passage hole on the inner surface of which is formed a female thread and a taper section, and by screwing the female thread onto the male thread the second retention member is installed onto the first retention member and the taper section constricts the leg section.

By use of the Present Disclosure, there results an earphone that grasps the cable by means of the first retention member installed on the housing and the second retention member installed on the first retention member. As such, there is offering of compact high audio quality earphone, of a simple structure, that is able to reliably prevent separation of the cable, and which can be easily manufactured, without forming a knot on the cable.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

While the Present Disclosure may be susceptible to embodiment in different forms, there is shown in the Figures, and will be described herein in detail, specific embodiments, with the understanding that the disclosure is to be considered an exemplification of the principles of the Present Disclosure, and is not intended to limit the Present Disclosure to that as illustrated.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

The following section describes in detail a mode for implementing the Present Disclosure, while referencing the drawings.

Figure 1:
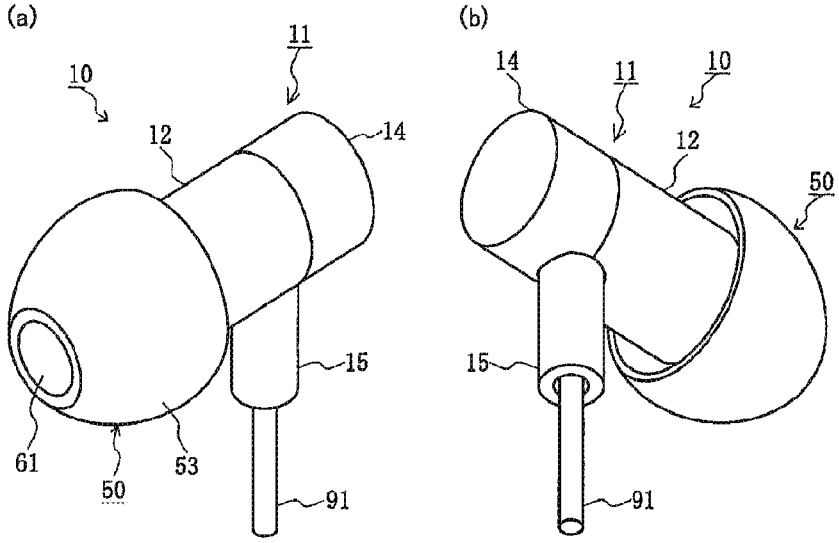
FIG. 1 is a perspective drawing of the earphone according to the implementation mode of the invention, wherein (a) is a view from an upper oblique and (b) is a view from a lower oblique.
Figure 2:
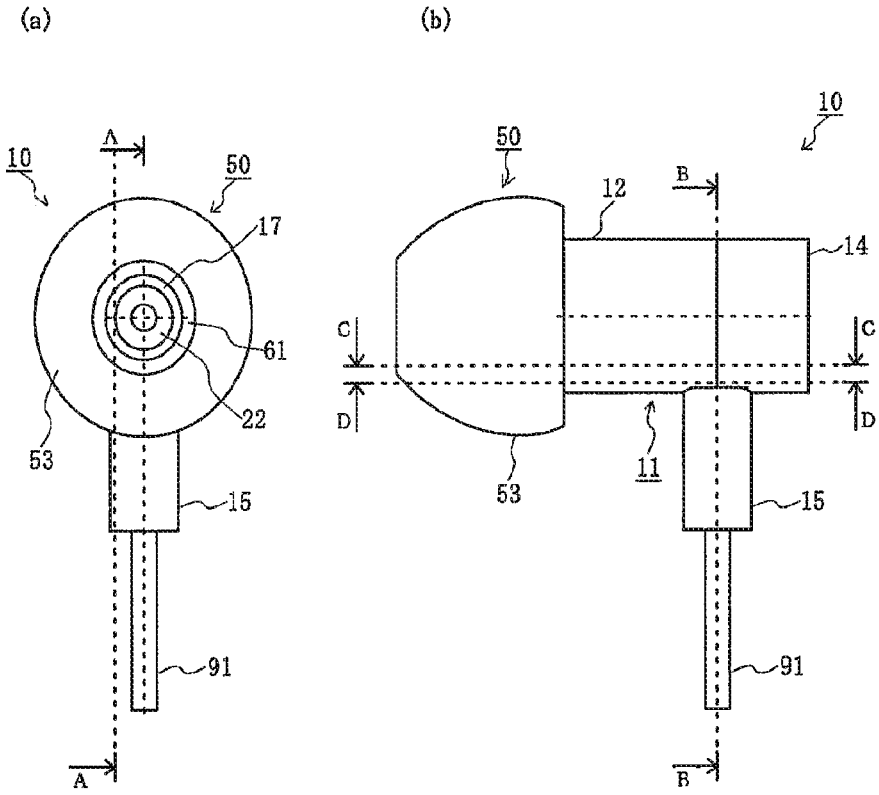
FIG. 2 is a two surface drawing of the earphone according to the implementation mode of the invention, wherein (a) is a front surface drawing and (b) is a side surface drawing.
Figure 3:
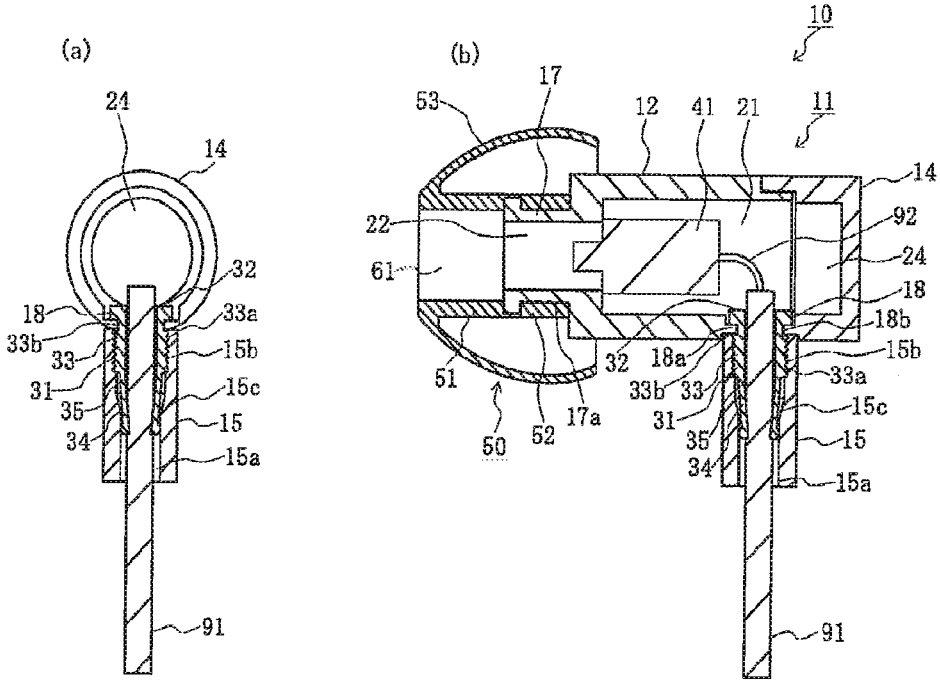
FIG. 3 is a cross section drawing of the earphone according to the implementation mode of the invention, wherein (a) is a cross section drawing along the line B-B in FIG. 2 and (b) is a cross section drawing along the line A-A in FIG. 2.

FIG. 1 is a perspective drawing of the earphone according to the implementation mode of the invention, FIG. 2 is a two surface drawing of the earphone according to the implementation mode of the invention, and FIG. 3 is a cross section drawing of the earphone according to the implementation mode of the invention. In FIG. 1, (a) is a view from an upper oblique and (b) is a view from a lower oblique; in FIG. 2, (a) is a front surface drawing and (b) is a side surface drawing; in FIG. 3, (a) is a cross section drawing along the line B-B in FIG. 2 and (b) is a cross section drawing along the line A-A in FIG. 2.

In the drawings, 10 is the earphone according to this implementation mode, and it is a compact audio generator that reproduces an audio signal, being used by mounting on the pinna of the user, and driven by an audio signal that is an electric signal. Earphone 10 possesses housing 11 that functions as a casing which internally stores driver unit 41 functioning as a speaker unit to generate sound by reproducing the audio signal, and possesses ear pad 50 that is installed on housing 11 and that functions as an outer ear canal insertion member for which at least a portion can be inserted into the outer ear canal.

Housing 11 provides main housing 12 positioned at the front surface side, and cover casing 14 connected to the aft side of main housing 12. As shown by FIG. 3, driver unit 41 is held within interior space 21 formed at the interior side of main housing 12. The aft surface of housing 12 is plugged by cover casing 14, and this forms aft space 24 being rearward of driver unit 41 (right side in FIG. 3(*b*)) within interior space 21. Additionally, driver unit 41 produces sound by causing vibration of a vibration plate not shown in the drawing.

Housing 11 is constituted of a resin such as a synthetic resin, for example, although it can be constituted of a metal such as aluminum, steel or copper, or constituted of a composite substance that combines such as a resin, carbon and a metal.

With this implementation mode, expressions used to describe the structure and operation of each component of earphone 10, such as those referring to directions upper, lower, left, right, forward, and aft, are relative and not absolute, and they are suited to the attitude of earphone 10 and its parts shown in the drawings, but it would be necessary to change these expressions in conjunction with a change of the attitude, in the event that the attitude of earphone 10 or its parts were to change.

To housing 11 there is installed the upper end of cable retainer 15 functioning as the cylinder-shaped second retention member for encompassing and retaining a portion of electric cable 91, which functions as a cable for which one end is connected to driver unit 41. The leading end of lead wire 92 exposed from the upper end of electric cable 91 is connected with conductive capacity to driver unit 41 by a connection means such as solder. Electric cable 91 extends from the lower end of cable retainer 15. Regarding display within the drawings, only the portion of electric cable 91 in the proximity of cable retainer 15 is depicted, and the remaining portion is not depicted. Correspondingly, to the end of electric cable 91 not shown in the drawings there exists opposite end lead wire 92, which is connected with conductive capacity to an audio device such as a music player, television, radio, or video deck, not shown in the drawings.

Main housing 12 incorporates cylinder-shaped pad installation section 17 that protrudes toward the forward side (left side in FIG. 3(*b*)). At pad installation section 17 there is formed housing acoustic conduit 22, functioning as an acoustic conduit, for which the aft end passes through to interior space 21 of main housing 12 and the forward end is an open cylinder-shaped opening. As result, sound generated by driver unit 41 passes through interior space 21 and housing acoustic conduit 22 and thereafter enters the outer ear canal of the user.

Ear pad 50 is installed onto pad installation section 17. Ear pad 50 is a single body member constituted of a soft material able to pliably deform such as silicon rubber, for example, and it provides cylinder-shaped main body 51 which is fitted to the periphery of pad installation section 17, and hood 53 as an elastically deforming section that widens in a slope from the leading end to the aft end of main body 51. To the aft end of main body 51 there is additionally formed flange-shaped mating protrusion 52 of a thickness that projects toward the interior. Mating protrusion 52 mates with channel-shaped mating cavity 17*a* (a section for connecting to main housing 12) that is formed at the base end of pad installation section 17, and this prevents ear pad 50 from separating from pad installation section 17.

Ear pad 50 possesses an overall shape similar to a mushroom or umbrella, and at the leading end portion, the leading end of hood 53 is connected to the leading end of main body 51, and a cavity is formed between the inner surface of hood 53 and the outer surface of main body 51. At the center of main body 51 there is formed pad acoustic conduit 61, a cylinder-shaped opening that is open at both ends and that functions as an acoustic conduit. In the mode wherein ear pad 50 is installed on pad installation section 17, pad acoustic conduit 61 links with housing acoustic conduit 22 for passage.

Hood 53 provides flexibility by being thinner than the thickness of main body 51, and therefore with ease it can be elastically deformed by reception of force. Accordingly, when ear pad 50 has been inserted into the outer ear canal, hood 53 elastically deforms to adapt to the inner surface shape of the outer ear canal, resulting in a sense of secure mounting and comfortable fit, without damaging the outer ear canal and without applying a reactive force against the inner surface of the outer ear canal.

The shape and material of ear pad 50 can also be of another type, such as made of a metal, for example.

With this implementation mode, cable retainer 15 is installed to housing 11 by means of cylinder-shaped collet 31 functioning as the first retention member which is installed on housing 11, as shown in FIG. 3. Collet 31 is formed as a single body member and constituted of a metal such as aluminum, steel or copper, although it can be constituted of a resin such as a synthetic resin, or constituted of a composite substance that combines such as a resin, carbon and a metal.

Cable retainer 15 is formed with clamping hole 15*a*, functioning as a passage hole that passes in the vertical direction through the interior from the upper end to the lower end. At the inner surface of the upper end of clamping hole 15*a* there is formed female thread 15*b* with a spiral-shaped female thread, and below female thread component 15*b* there is formed taper 15*c* with a taper applied that declines so that the inner diameter becomes smaller as progressing downward.

Collet 31 provides approximately ring-shaped flange 32, approximately cylinder-shaped trunk 33 extending downward form the lower surface of flange 32, and leg 34 extending downward at one end, specifically, the lower end, of trunk 33, and in the center of collet 31 there is formed cable passage hole 35 functioning as a passage hole that passes in the vertical direction through the interior of flange 32, trunk 33, and leg 34.

At the outer peripheral surface of trunk 33 there is formed male thread 33*a* with a spiral-shaped male thread. Female thread 15*b* of cable retainer 15 is screwed to male thread 33*a*. Additionally, on the outer peripheral surface of trunk 33 at the border with flange 32, specifically, at the upper end, there is formed a plurality (four, for example) of flat surface 33*b*, functioning as a rotation stop component. Flat surface 33*b* mates with flat inner side surface 18*b* of installation cornered hole 18 which is an installation hole formed to pass through the lower side wall of housing 11, and this mating prevents collet 31 from rotating relative to the lower side wall of housing 11.

Cable insertion hole 35 is formed so that the inner diameter is larger than the outer diameter of electric cable 91. Accordingly, there is ability to easily insert electric cable 91 within cable insertion hole 35, and electric cable 91 inserted into within cable insertion hole 35 can be shifted in the axial direction relative to collet 31. However, when there is performed tightening by screwing female thread 15*b* of cable retainer 15 onto male thread 33*a* of collet 31, cable retainer 15 rises relative to collet 31 and the lower end of taper 15*c* clamps leg 34 from the outer side. The result is that leg 34 elastically deforms, with its inner diameter contracting, and by clamping this grasps the outer surface of electric cable 91. In this way, electric cable 91, which has been inserted within cable insertion hole 35, is strongly retained, and its separation from housing 11 is prevented.

With this implementation mode, electric cable 91 is grasped and clamped by cable retainer 15 and collet 31, and therefore it cannot separate from housing 11. Accordingly, there is no need to form a knot in electric cable 91 or lead wire 92 to prevent separation, as with the former technology earphone described in Prior Art. The result, as shown in FIG. 3(*b*), is that the interior of interior space 21 aft of driver unit 41 and within aft space 24 is not dedicated to a knot, and maintained in its current form it enables ample producing of function as an acoustic space. In particular, there is no dedicated use for a knot that has variation in size due to formation by a manual operation, and therefore the interior of interior space 21 aft of driver unit 41 and within aft space 24 is always maintained with a fixed size and shape, thereby making uniform the function as an acoustic space, with the result that the audio quality of earphone 10 is improved and made uniform.

The following section describes in detail the installation condition and structure of collet 31.

Figure 4:
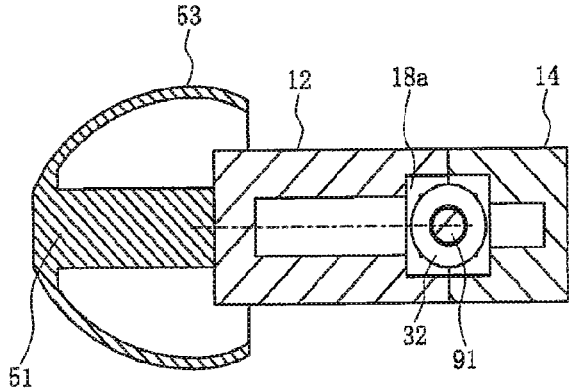
FIG. 4 is a cross section drawing that shows the installation cornered hole of the earphone according to the implementation mode of the invention, wherein (a) is a cross section drawing along the line C-C in FIG. 2 and (b) is a cross section drawing along the line D-D in FIG. 2.
Figure 4:
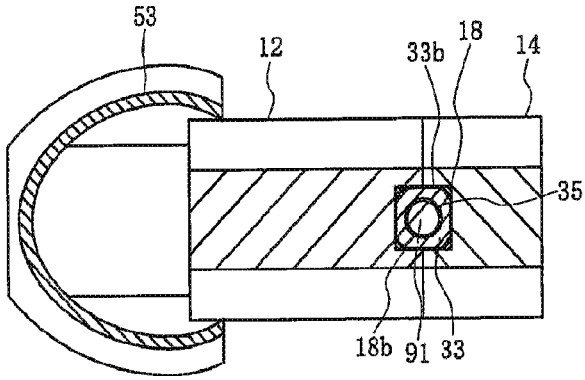
Figure 5:
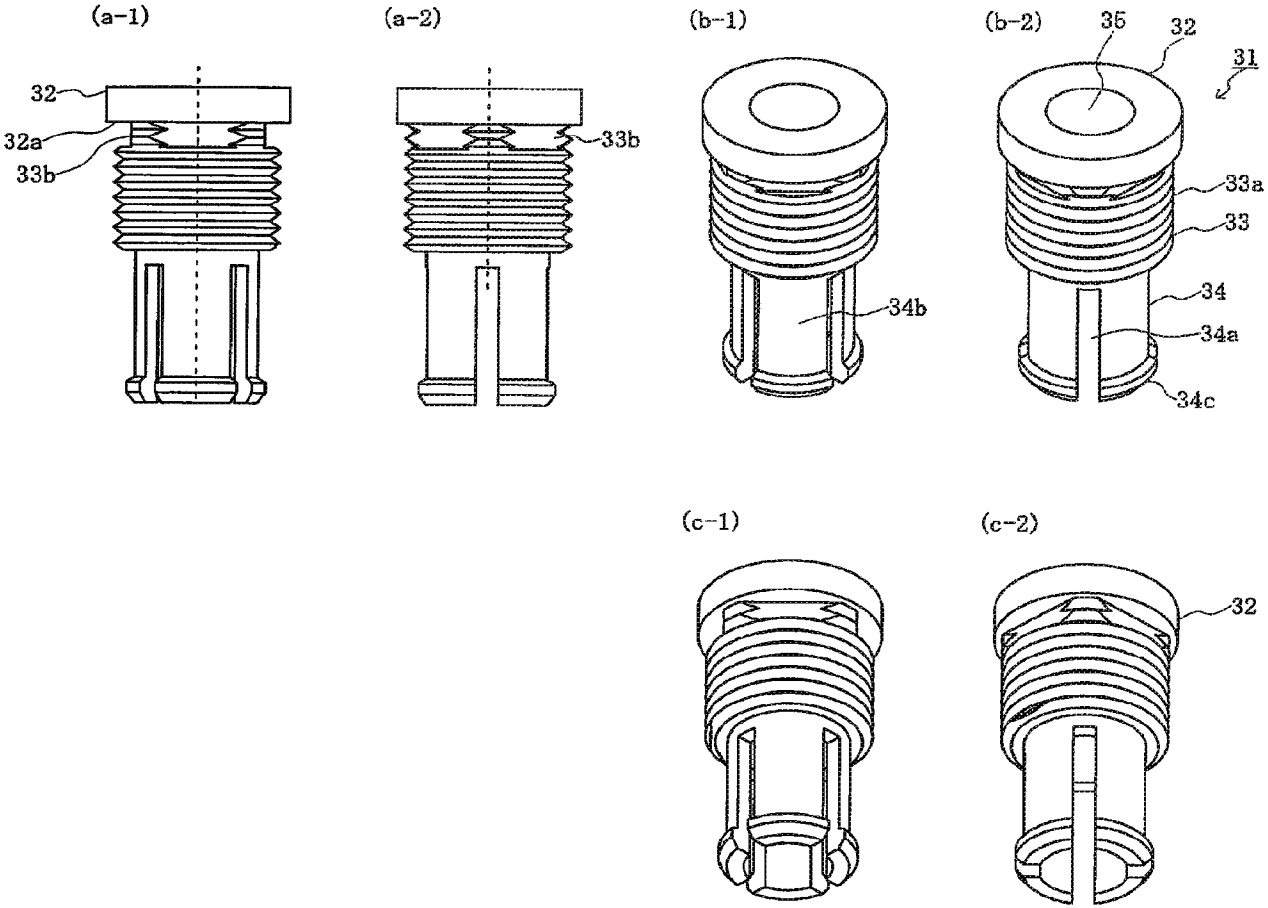
FIG. 5 is a drawing that shows the structure of the collet according to the implementation mode of the invention, wherein (a-1) and (a-2) are first and second side surface drawings, (b-1) and (b-2) are first and second upper oblique drawings, and (c-1) and (c-2) are first and second lower oblique drawings.
Figure 6:
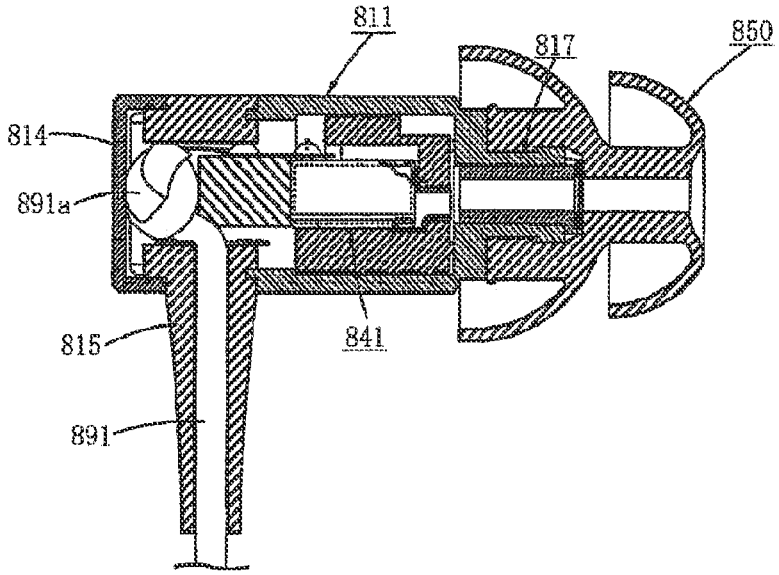
FIG. 6 PRIOR ART
FIG. 6 is a cross section drawing that shows the structure of the former technology earphone.

FIG. 4 is a cross section drawing that shows the installation cornered hole of the earphone according to the implementation mode of the invention, and FIG. 5 is a drawing that shows the structure of the collet according to the implementation mode of the invention. In FIG. 4, (a) is a cross section drawing along the line C-C in FIG. 2 and (b) is a cross section drawing along the line D-D in FIG. 2. In FIG. 5, (a-1) and (a-2) are first and second side surface drawings, (b-1) and (b-2) are first and second upper oblique drawings, and (c-1) and (c-2) are first and second lower oblique drawings.

As shown in FIG. 4, installation cornered hole 18 of housing 11 is formed to pass through the lower side wall of housing 11, and it is a multiple corner passage hole formed with straddling of the borderline between the main housing 12 and the cover casing 14. Installation cornered hole 18 can be a three-cornered hole, a five-cornered hole, a six-cornered hole, or a multiple corner hole of another type, but this section describes the condition in which it is a square shape, as shown in FIG. 4.

As shown in FIG. 3(*b*) and FIG. 4(*a*), square-shaped cavity 18*a* is formed at the inner surface side of housing 11 with a size larger than installation cornered hole 18, and it functions as a so-called spot facing. The upper surface of cavity 18*a* is flat, and it opposes lower surface 32*a* of flange 32 of collet 31. Additionally, the four instances of inner side surface 18*b* of installation cornered hole 18 are flat, and they oppose the instances of flat surface 33*b* of collet 31.

As previously described, collet 31 provides flat surface 33*b* formed on the outer peripheral surface of trunk 33 at the border with flange 32. As shown in FIG. 5, this flat surface 33*b* inwardly hollows the outer peripheral surface of trunk 33 which is a cylindrical surface, and it is formed such that each instance will oppose a respective side surface of a square-shaped pillar. That being the case, lower surface 32*a* of flange 32 greatly extends in the outward direction from the upper end of flat surface 33*b*.

Additionally, to leg 34 of collet 31 there are formed at equal intervals a plurality of slit 34*a*, and these divide cylinder-shaped leg 34 into a plurality of band plates 34*b*. The quantity of slit 34*a* can be two slits, three slits, five slits, or any number of slits, but this section describes the condition in which four slits are used, as shown by FIG. 5. In this case, leg 34 is divided into four instances of long thin band plate 34*b*.

Slit 34*a* is open at the lower end of leg 34, and it is a long thin cutout extending in the vertical direction with its upper end closed in the vicinity of the component connecting trunk 33. Accordingly, leg 34 is formed with partition by slit 34, being instances of a cantilever-shaped member with the upper end as the base and the lower end as the free end, elastically deforming. Additionally, on the lower end outer surface of each leg 34 there is formed protrusion 34*c*. It is preferable that a tapered surface be formed at the lower end of protrusion 34*c*. It is also acceptable to omit protrusion 34*c* for convenience.

With main housing 12 and cover casing 14 in the separated condition, collet 31 is installed to either installation cornered hole 18 at the side of main housing 12 or at the side of cover casing 14. Specifically, the component formed by flat surface 33*b* of trunk 33 is inserted into the portion of installation cornered hole 18 that is on main housing 12 or on cover casing 14, with another instance of flat surface 33*b* of trunk 33 made to face the opposite inner side surface 18*b* of installation cornered hole 18.

In continuation, when joining main housing 12 and cover casing 14, the component formed by another instance of flat surface 33*b* of trunk 33 is inserted into the installation cornered hole 18 that is on the opposite side, belonging to either main housing 12 or cover casing 14, with the former instance of flat surface 33*b* of trunk 33 facing the opposite inner side surface 18*b* of installation cornered hole 18. This results in the condition in which each flat surface 33*b* of trunk 33 faces a respective flat inner side surface 18*b* of installation cornered hole 18. In addition, as shown in FIG. 4(*a*), flange 32 is housed within cavity 18*a*, and lower surface 32*a* of flange 32 opposes the upper surface of cavity 18*a*. Because flange 32 extends outward farther than flat surface 33*b*, there is entered a condition in which lower surface 32*a* of flange 32 mates with the upper surface of cavity 18*a*, and this prevents the separating of collet 31 from installation cornered hole 18.

Generally, electric cable 91 is passed through cable insertion hole 35 before installing collet 31 onto housing 11. This is because the leading end of lead wire 92 exposed from the upper end of electric cable 91 to is generally connected to driver unit 41 before joining main housing 12 and cover casing 14.

Then cable retainer 15 is installed so as to cover the outer side of collet 31 from below. Stated differently, leg 34 and trunk 33 of collet 31 relatively advance into clamping hole 15*a* of cable retainer 15 from the upper end of cable retainer 15. Thereafter, female thread 15*b* of cable retainer 15 is screwed onto male thread 33*a* on trunk 33 of collet 31.

In the condition in which female thread 15*b* has been threaded onto male thread 33*a*, when tightening by further rotating cable retainer 15 around collet 31, cable retainer 15 rises relative to collet 31, and the lower end of taper 15*c* is constricts leg 34 from the outer side. This action causes leg 34 to elastically deform and therefore the inner diameter of cable insertion hole 35 to contract, by which electric cable 91 passed through cable insertion hole 35 is grasped by leg 34. When there has been formed protrusion 34*c* at the lower end outer surface of leg 34, as shown in FIG. 5, the amount of deforming at the lower end of leg 34 becomes greater, thereby enabling a stronger grasp of electric cable 91. Moreover, the force by which leg 34 grasps electric cable 91 can be suitably adjusted by adjusting the shape of taper 15*c* and the amount of protrusion of protrusion 34*c*.

In the condition in which female thread 15*b* has been threaded onto male thread 33*a*, by performing tightening through further rotating cable retainer 15 around collet 31, flange 32 of collet 31 and cable retainer 15 enter a condition interposing the lower side wall of housing 11 from above and below, and this strongly fixes cable retainer 15 and collet 31 to the lower side wall of housing 11. In this situation, flat lower surface 32*a* of flange 32 enters a condition of pressing the flat upper surface of cavity 18*a* from above, stabilizing the attitude of cable retainer 15 and collet 31 relative to the lower side wall of housing 11.

It is preferable that the shape of cable retainer 15 and the amount of protrusion of protrusion 34*c* of collet 31 be adjusted so as to grasp electric cable 91 with suitable force at the time that female thread 15*b* and male thread 33*a* have been tightened to an extent that results in flange 32 of collet 31 and cable retainer 15 firmly interposing the lower side wall of housing 11.

In this way, earphone 10 of this implementation mode possesses ear pad 50, housing 11 onto which ear pad 50 is installed, driver unit 41 which is disposed within housing 11 and which generates sound, collet 31 into which electric cable 91 connected at one end to driver unit 41 is inserted and which is itself directly connected to housing 11, and cable retainer 15 into which electric cable 91 is inserted and which is installed onto collet 31, and when cable retainer 15 is installed onto collet 31, collet 31 grasps electric cable 91.

Using a simple structure, this enables grasping of electric cable 91 and reliably prevents separation of electric cable 91. This also simplifies manufacturing because there is no need to form a knot on electric cable 91. Furthermore, a knot on electric cable 91 does not exist within housing 11, and therefore the space within housing 11 can fully yield functioning as an acoustic space, and because the functioning as an acoustic space is uniform, there is enabled obtaining of high quality audio even with compacting of earphone 10.

Housing 11 provides main housing 12 that houses driver unit 41, and cover casing 14 that plugs the aft surface of main housing 12, and collet 31 is installed to installation cornered hole 18 formed with straddling of the borderline between main housing 12 and cover casing 14. Accordingly, there is ability to perform the installation operation for collet 31 reliably, easily, and in a short amount of time.

Moreover, collet 31 provides trunk 33 on the outer surface of which is formed male thread 33*a*, as well as leg 34 connected to one end of trunk 33, and cable retainer 15 provides clamping hole 15*a* on the inner surface of which is formed female thread 15*b* and taper 15*c*, and by screwing female thread 15*b* onto male thread 33*a*, collet 31 is installed, and taper 15*c* constricts leg 34. Accordingly, by causing rotation of female thread 15*b* without rotating of male thread 33*a*, there is ability to simply install cable retainer 15 onto collet 31 and to grasp electric cable 91.

While a preferred embodiment of the Present Disclosure is shown and described, it is envisioned that those skilled in the art may devise various modifications without departing from the spirit and scope of the foregoing Description and the appended Claims.

What is claimed is:

1. An earphone, comprising:

an outer ear canal insertion member for which at least a portion is inserted into the outer ear canal;

a housing onto which the outer ear canal insertion member is installed;

a driver unit which is disposed within the housing and which generates sound;

a first retention member through the interior of which passes a cable connected at one end to the driver unit and which is itself directly installed to the housing;

a second retention member through the interior of which passes the cable and which is itself installed to the first retention member; and when the second retention member is installed to the first retention member, the first retention member grasps the cable.

2. The earphone of claim 1, wherein the housing provides a main housing that houses the driver unit, and a cover casing that plugs the aft surface of the main housing.

3. The earphone of claim 2, wherein the first retention member is installed to an installation hole formed with straddling of the borderline between the main housing and the cover casing.

4. The earphone of claim 3, wherein the first retention member provides a trunk section on the outer surface of which is formed a male thread, as well as a leg section connected to one end of the trunk section.

5. The earphone of claim 4, wherein the second retention member provides a passage hole on the inner surface of which is formed a female thread and a taper section, and by screwing the female thread onto the male thread the second retention member is installed onto the first retention member and the taper section constricts the leg section.

6. The earphone of claim 1, wherein the first retention member provides a trunk section on the outer surface of which is formed a male thread, as well as a leg section connected to one end of the trunk section.

7. The earphone of claim 6, wherein the second retention member provides a passage hole on the inner surface of which is formed a female thread and a taper section, and by screwing the female thread onto the male thread the second retention member is installed onto the first retention member and the taper section constricts the leg section.

* * * * *